US010161680B2

(12) United States Patent
Caro et al.

(10) Patent No.: US 10,161,680 B2
(45) Date of Patent: Dec. 25, 2018

(54) METHOD AND SYSTEM FOR THE THERMAL PROCESSING OF A MATERIAL

(71) Applicant: EISENMANN SE, Boeblingen (DE)

(72) Inventors: Carolina Acuna Caro, Stuttgart (DE); Uwe Neumann, Boeblingen (DE)

(73) Assignee: EISENMANN SE, Boeblingen (DE)

( * ) Notice: Subject to any disclaimer, the term of this patent is extended or adjusted under 35 U.S.C. 154(b) by 275 days.

(21) Appl. No.: 14/609,692

(22) Filed: Jan. 30, 2015

(65) Prior Publication Data

US 2015/0211794 A1 Jul. 30, 2015

(30) Foreign Application Priority Data

Jan. 30, 2014 (DE) ..... 10 2014 001 257

(51) Int. Cl.

| | |
|---|---|
| ***F27B 7/00*** | (2006.01) |
| ***F27B 7/08*** | (2006.01) |
| ***F27B 7/10*** | (2006.01) |
| ***F27B 7/14*** | (2006.01) |
| ***F27B 7/34*** | (2006.01) |
| ***F27B 7/20*** | (2006.01) |

(52) U.S. Cl.

CPC ..... *F27B 7/08* (2013.01); *F27B 7/10* (2013.01); *F27B 7/14* (2013.01); *F27B 7/20* (2013.01); *F27B 7/34* (2013.01)

(58) Field of Classification Search

CPC ..... F27B 7/08; F27B 7/10; F27B 7/14; F27B 7/34

See application file for complete search history.

(56) References Cited

U.S. PATENT DOCUMENTS 3,618,918 A * 11/1971 Tembe ..... C10B 1/10 432/113
3,805,406 A * 4/1974 Castonoli ..... F26B 11/0413 165/87
5,305,533 A * 4/1994 Alexander ..... F26B 11/028 34/108
5,658,094 A * 8/1997 Clawson ..... B09C 1/06 110/236
6,110,430 A * 8/2000 Swisher, Jr. ..... B09C 1/06 110/226

(Continued)

FOREIGN PATENT DOCUMENTS

DE 29 31 367 A1 2/1980
DE 34 47 079 A1 3/1986

(Continued)

OTHER PUBLICATIONS

JP2005009712A—machine translation.*

(Continued)

*Primary Examiner* — Nathaniel Herzfeld
(74) *Attorney, Agent, or Firm* — Schroeder Intellectual Property Law Group, LLC

(57) ABSTRACT

A method and system for thermal processing of a material conveyed in a rotary kiln with a rotatable kiln drum, the drum wall of which delimits a heatable drum chamber, from a drum inlet to a drum outlet of the kiln drum. The drum chamber is heated directly by conducting a heating gas into the drum chamber. The drum chamber is also heated indirectly by warming the drum wall at least in areas.

16 Claims, 2 Drawing Sheets

(56) References Cited

U.S. PATENT DOCUMENTS

| | | | | |
|---|---|---|---|---|
| 6,228,143 | B1 * | 5/2001 | Aiken | C22B 7/001 266/205 |
| 6,412,428 | B1 * | 7/2002 | Promuto | C02F 11/12 110/110 |
| 6,749,425 | B1 * | 6/2004 | Nakayama | F27B 9/06 432/107 |
| 2002/0009399 | A1 * | 1/2002 | Baudhuin | F23G 5/006 422/184.1 |

FOREIGN PATENT DOCUMENTS

| | | | | |
|---|---|---|---|---|
| DE | 35 31 647 | A1 | | 3/1987 |
| FR | 2 433 076 | | | 3/1980 |
| JP | 58045733 | A | * | 3/1983 |
| JP | 2003292964 | A | * | 10/2003 |
| JP | 2005009712 | A | * | 1/2005 |

OTHER PUBLICATIONS

JP2003292964A—machine translation.*

Excerpt from Grote, K.-H.; Feldhusen, J. (Hrsg.): Dubbel-Taschenbuch für Den Mashinenbau; 23. Auflage. Berlin, Heidelberg: Springer-Verlag, 2011, S. K7-K17.—e-ISBN 978-3-641-17306-6. DOI: 1007/978-3-642-17306-6. 12 pages.

* cited by examiner

METHOD AND SYSTEM FOR THE THERMAL PROCESSING OF A MATERIAL

RELATED APPLICATIONS

This application claims priority to German Patent Application No. 10 2014 001 257.3 filed Jan. 30, 2014, the contents of which are incorporated herein by reference.

TECHNICAL FIELD

The invention relates to a method for the thermal processing of a material, in particular of used foundry sand or of road construction material, in a rotary kiln with a rotatable kiln drum, the drum wall of which delimits a heatable drum chamber, through which the material is conveyed from a drum inlet to a drum outlet of the kiln drum.

The invention also relates to a system for the thermal processing of a material, in particular of used foundry sand or road construction material, which includes a) a rotary kiln with a rotatable kiln drum, the drum wall of which delimits a heatable drum chamber, through which the material can be conveyed from a drum inlet to a drum outlet of the kiln drum; and b) a heating system, by means of which the drum chamber can be heated.

BACKGROUND OF THE INVENTION

There are some industrial processes in which materials arise that can be thermally processed and hereby even regenerated if necessary. These include used foundry sands, for example, which can comprise residues of organic and inorganic binders, for example resins or bentonite. Bentonite is calcined by means of thermal processing, for example. Organic binders are oxidised, on the other hand, due to which the carbon content remaining in the sand can be reduced to less than 0.8 percent by weight.

With regard to the thermal processing of used foundry sands in rotary kilns, it is known in particular to heat these directly using a gas burner, in that the flame points into the drum chamber and the heating gases produced are conducted into the drum chamber, and also to operate in a direct flow. This means that the material to be processed is conveyed in the same direction through the kiln drum as the flow direction of the heating gases.

Flue gases arise in the thermal processing. In such an operation of a rotary kiln, however, these have a relatively high carbon monoxide (CO) concentration. The CO content can only be reduced by an afterburning system, which causes the operating costs of the system to increase.

Moreover, in direct flow operation the heating gas coming from the gas burner must have a relatively high temperature, especially in the starting area of the rotary kiln, as the regenerated used foundry sand must have a temperature of more than 700° C. on leaving the rotary kiln. Since the drum atmosphere cools down in the conveying direction or flow direction, an adequate starting temperature must be ensured accordingly at the start. However, this leads to high demands on the temperature resistance of the kiln material, especially in the starting area of the kiln drum, which likewise results in high costs.

It is true that there are basic approaches to operating a rotary kiln in counterflow, in which the conveying direction of the material is opposed to the flow direction of the heating gas and the material exits the kiln drum in the area of the burner flame. In this case, although the temperature at the burner flame can be lower than in direct flow operation, the exit temperature of the flue gases, which cool down while flowing through the kiln drum, then also drops. This can lead to an undesirable condensing of hydrocarbons in the flue gas conduits.

Even in the case of counterflow operation, afterburning of the flue gases is also necessary, as in addition to the vaporised hydrocarbons, dioxins can also arise from the organic binder, and these must be removed from the flue gases.

Similar problems arise in the thermal processing of road construction material. Older roads in particular were often constructed using a road surface in which pitch (coal tar) was used as a binding agent. However, pitch contains a high proportion of environmentally harmful polycyclic aromatic hydrocarbons (PAHs) with the key substance benzo(a)pyrene. The use or recycling of such road construction material is now no longer permitted.

The direct recycling of purely mechanically processed road construction material containing pitch is ruled out, therefore, and the grit contained in it must be freed from the binding agent containing pitch before the grit can then be used for the production of new asphalt.

SUMMARY OF THE INVENTION

An object of the invention, therefore, is to provide a method and a system of the type named at the beginning that take account of these considerations.

This object may be achieved with a method of the type named at the beginning in that a) the drum chamber is heated directly by conducting a heating gas into the drum chamber; and b) the drum chamber is heated indirectly by warming the drum wall at least in areas.

It was recognized according to the invention that by the combination of direct heating of the drum chamber, such as is known from using a gas burner, for example, with indirect heating of the drum chamber via its drum wall, an even temperature progression can be achieved in the kiln drum. In particular, a cooling of the flue gases on the path through the kiln drum can be prevented. In addition, the temperature at the direct heating device can be reduced as against sole direct heating, due to which the requirements concerning the kiln material are less high. Afterburning of the flue gases is then unnecessary, as these are at a sufficiently high temperature on exiting the kiln drum.

By conducting the heating gas into the drum chamber at the drum inlet to the kiln drum, the rotary kiln can be operated according to the direct flow principle relative to the direct heating.

With regard to the indirect heating, it is favourable if the drum wall is warmed by conducting a heating medium onto the drum wall from outside.

It is particularly advantageous in this case if the heating medium is conducted in one direction from the drum outlet to the drum inlet of the kiln drum along the outside of the drum wall. The indirect heating thus takes place according to the counterflow principle relative to the conveying direction of the material through the kiln drum. The kiln drum can thus be heated in its longitudinal direction with opposed temperature gradients, so that a homogeneous temperature profile is built up in the drum chamber as a whole.

So that the heating medium flows over the drum wall targetedly, it is favourable if the heating medium is conducted through an annular chamber surrounding the kiln drum.

As explained above, the maximum temperature prevailing locally in the drum chamber, especially in the area of the direct heating, can be lowered. It is advantageously possible by this to use a kiln drum of which at least the drum wall and/or a conveying structure on the inner shell surface of the drum wall are made of steel. The steel used is chosen in this case as a function of the temperatures attained in the drum chamber.

With regard to the system of the type named at the beginning, the object indicated above may be achieved in that c) the heating system comprises a first, direct heating device, by means of which the drum chamber can be heated directly, in that a heating gas can be generated and conducted into the drum chamber; and d) the heating system comprises a second, indirect heating device, by means of which the drum chamber can be heated indirectly, in that the drum wall can be warmed at least in areas.

The advantages achieved by these measures correspond to the advantages explained above relative to the method.

If the direct heating device comprises a burner unit, which is arranged at the drum inlet to the kiln drum, so that heating as is conducted there into the drum chamber, established techniques can be used for a direct firing of the drum chamber.

It is favourable if the indirect heating device comprises a burner unit, by which a heating medium can be generated, and at least one conduit, through which the heating medium can be conducted from outside onto the drum wall. Known heating techniques based on the use of burners can thus be used for the indirect heating device also.

As explained above, it is favourable for a homogeneous temperature in the drum chamber if the indirect heating device comprises a flow path, through which the heating medium can be conducted in the direction from the drum outlet to the drum inlet of the kiln drum along the outside of the drum wall.

The flow path for the heating medium can advantageously be provided in that the indirect heating device comprises a cladding tube with an inlet connection for heating medium and an outlet connection for heating medium, which tube is arranged coaxially to the kiln drum in such a way that an annular chamber surrounding the kiln drum is formed, through which heating medium of the indirect heating device can be conducted.

It is advantageous if a helical conducting structure is arranged in the annular chamber, so that the heating medium flows helically from the inlet connection to the outlet connection and around the kiln drum. It can be guaranteed in this way that heating medium flows over all areas of the kiln drum uniformly and targetedly.

As explained above, of the kiln drum at least the drum wall and/or a conveying structure on the inner shell surface of the drum wall can be made of steel.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An embodiment of the invention is explained in greater detail below with reference to the drawings.

DETAILED DESCRIPTION OF THE INVENTION

While this invention is susceptible to embodiments in many different forms, there is described in detail herein, preferred embodiments of the invention with the understanding that the present disclosures are to be considered as exemplifications of the principles of the invention and are not intended to limit the broad aspects of the invention to the embodiments illustrated.

Figure 1:
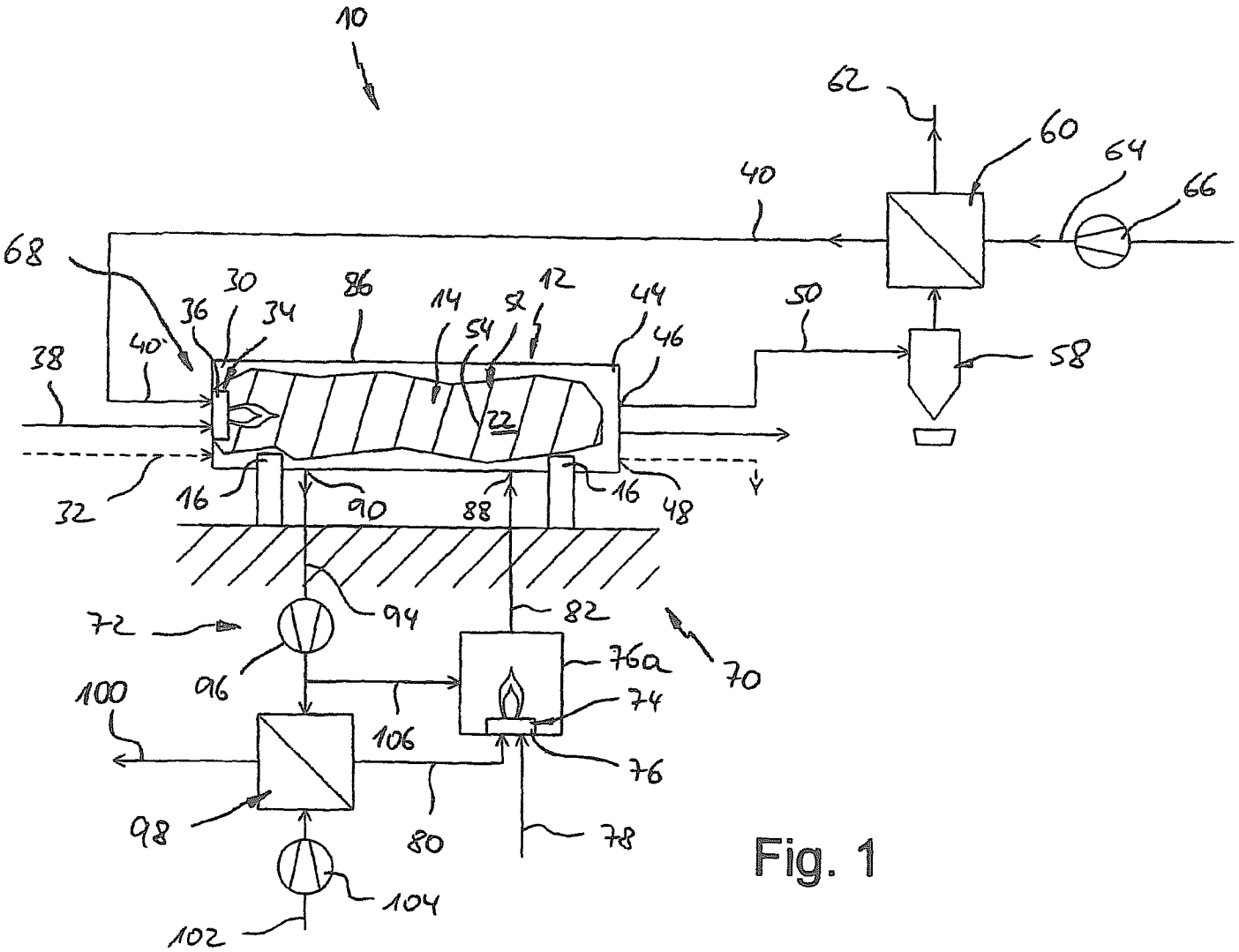
FIG. 1 shows a schematic layout view of a system for the thermal processing of a material using a rotary kiln.
Figure 2:
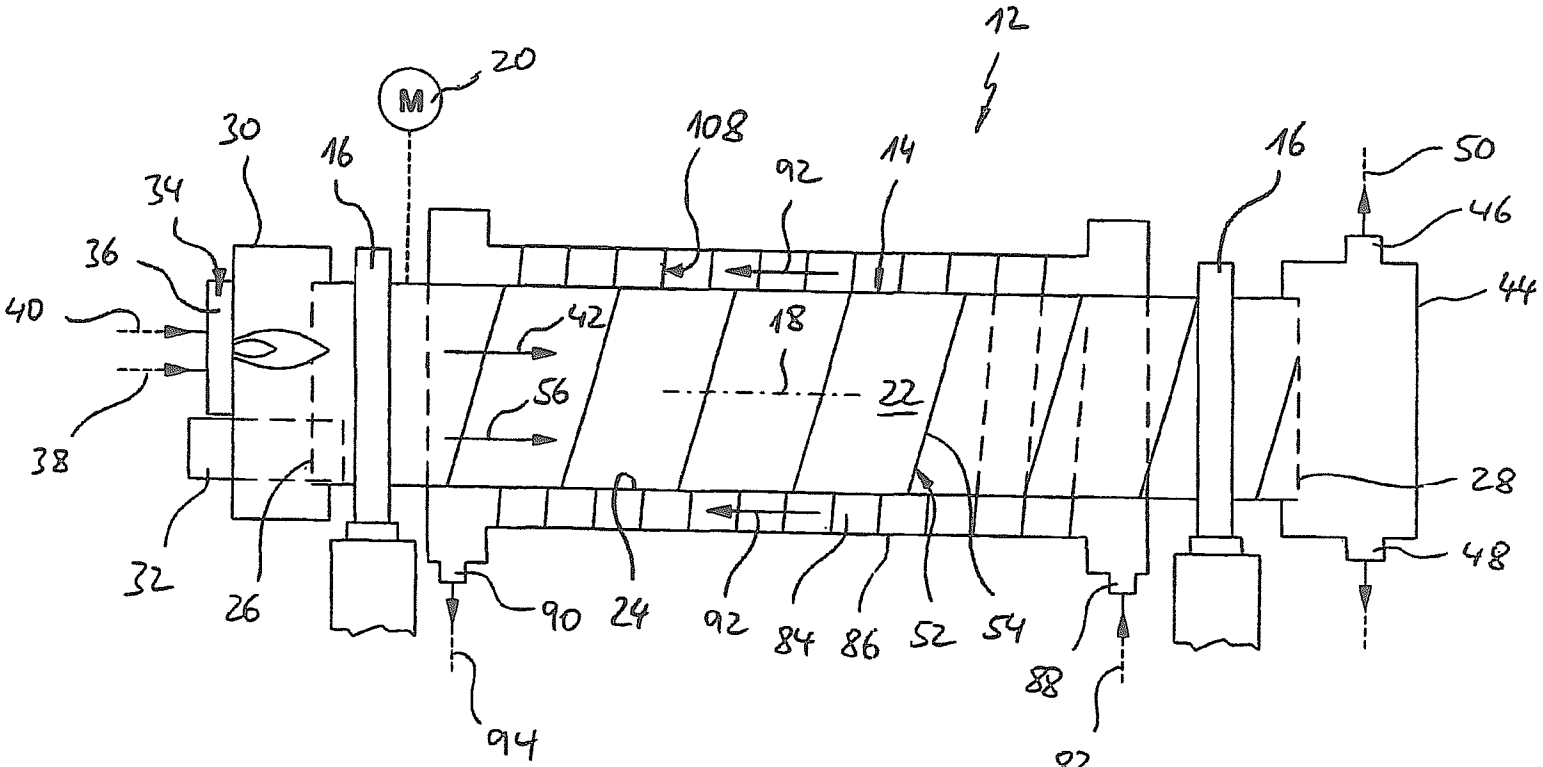
FIG. 2 shows a partial view through a schematic section of the rotary kiln on a larger scale.

In FIG. 1, 10 designates as a whole a schematically shown system for the thermal processing of a material. The material to be processed can be used foundry sand, for example, as explained at the beginning, or also road construction material. The system 10 has a rotary kiln 12, which is first explained with reference to FIG. 2, which shows the rotary kiln in greater detail, but likewise only schematically.

The rotary kiln 12 comprises a kiln drum 14, which is supported by means of pivot bearings 16 rotatably about its longitudinal axis 18, in order to be driven by means of a motor 20. The kiln drum 14 has a drum chamber 22, which is delimited by a drum wall 24 and is open at a drum inlet 26 at one end and a drum outlet 28 lying opposite this. At the drum inlet 26, the kiln drum 14 leads into an inlet flange 30, which supports a supply connection piece 32, via which material to be processed can be introduced into the kiln drum 14 through the drum inlet 26. In FIG. 1 the supply connection piece 32 is illustrated as a dashed arrow.

Also arranged at the inlet flange 30 is a burner unit 34 in the form of a gas burner 36, which is supplied with fuel gas from a fuel gas source, which is not shown itself, via a fuel gas conduit 38. The gas burner 36 is supplied with burner air required for its operation via an air conduit 40.

The gas burner 36 produces heating gas in a manner known in itself, which gas is conducted in a heating gas flow direction 42 indicated by an arrow into the drum chamber 22, and flows through this and heats it directly.

The kiln drum 14 leads at the drum outlet 28 into an outlet flange 44, which comprises a flue gas outlet 46 and a material outlet 48. Flue gas arising in the thermal treatment of the material in the kiln drum 14 flows from the drum chamber 22 out into the outlet flange 44 and from there via the flue gas outlet 46 into a flue gas conduit 50; this will be looked at again is below.

On its inner shell surface the drum wall 24 bears a conveying structure 52, for example a continuous conveyor screw 54. When the kiln drum 14 rotates, material that enters the drum chamber 22 through the supply connection piece 32 is conveyed by means of the conveyor screw 54 through this in a conveying direction 56 to the material outlet 28 of the kiln drum 14, where it enters the outlet flange 44 and is delivered via its material outlet 48.

The conveyor screw 54 can also comprise plates running parallel to the longitudinal axis 18 and protruding radially inwards, which plates are not shown here. Upon rotation of the kiln drum 14, these plates initially carry the material upwards until, upon reaching a certain height, the material falls downwards again from the plates. Even better mixing of the material is achieved by this as against a conveyor screw 18 without such additional plates.

With regard to the heating gas flow direction 42 and the conveying direction 56 of the material to be processed, the rotary kiln 12 is consequently operated in the so-called direct flow method.

As FIG. 1 shows, the flue gas is routed from the outlet flange 44 via the flue gas conduit 50 to a dust removal device 58. From there the now dedusted flue gas passes into an adjustable distribution unit 60, by means of which a portion of the cleaned flue gas can be conducted into the air conduit 40 for the gas burner 36 and the remaining portion of the cleaned flue gas can be discharged via a conduit 62.

Fresh air from a fresh air conduit 64 can also be conducted into the air conduit 40 by means of the distribution unit 60 using a fresh air fan 66, so that the ratio of a mixture of cleaned flue gas and fresh air can be adjusted, which mixture then reaches the gas burner 36 as combustion air.

The combustion air can consequently be provided by pure cleaned flue gas, by pure fresh air or by a mixture of flue gas and fresh air in an adjustable ratio.

The burner unit 34 with the related components is an embodiment of a first, direct heating device 68, by means of which the drum chamber 22 can be heated directly, in that a heating gas can be generated and conducted into the drum chamber 22. This heating device 68 is part of a heating system designated as a whole by 70, by means of which the drum chamber 22 can be heated.

In addition to the direct heating device 68, this heating system 70 comprises another, second, indirect heating device 72 illustrated in FIG. 1, by means of which the drum chamber 22 can be heated indirectly, in that its drum wall 24 can be warmed at least in areas. To do this, the indirect heating device produces a heating medium.

In the present embodiment, the indirect heating device 72 comprises a second burner unit 74 in the form of a second gas burner 76, which is supplied with fuel gas from a fuel gas source, which is not shown, via a fuel gas conduit 78. The second gas burner 76 is supplied with burner air required for its operation via an air conduit 80. The heating medium of the indirect heating device 72 is thus likewise a heating gas.

This heating gas is conducted via a heating gas conduit 82 to the drum wall 24 of the kiln drum 14, on which it can flow along the outside. As shown again in FIG. 2, the kiln drum 14 is surrounded by an annular chamber 84, which is formed by a cladding tube 86 being arranged coaxially to the kiln drum 14.

The cladding tube 86 comprises an inlet connection 88 and an outlet connection 90 for heating medium, so that the annular chamber 84 offers a flow path for the heating gas of the second gas burner 76. The inlet connection 88 is arranged at the end of the cladding tube 86 that points in the direction of the outlet flange 44 of the rotary kiln 12. The outlet connection 90 is located at the end of the cladding tube 86 that points in the direction of its inlet flange 30. The inlet connection 88 is connected to the heating gas conduit 82 from the second gas burner 76, so that the heating gas produced by this can be conducted in a counterflow direction 92 along the outside of the drum wall 24, which direction points from the drum outlet 28 to the drum inlet 26 of the kiln drum 14.

Relative to the conveying direction 56 of the material to be processed and the flow direction 42 of the heating gas of the first gas burner 36 through the drum chamber 22, the indirect heating device 72 thus follows the counterflow principle.

The outlet connection 90 of the cladding tube 86 is connected to a return conduit 94 with a fan 96, which leads at the other end to a second adjustable distribution unit 98, which is shown in FIG. 1 and to which the heating gas of the second gas burner 76 passes after flowing through the annular chamber 84.

This can conduct the used heating gas completely or partially into the air conduit 80 for the second gas burner 76 or discharge it fully or partially via a conduit 100.

The second distribution unit 98 can supply fresh air from a fresh air conduit 102 to the air conduit 80 using a fresh air fan 104, so that an adjustable mixture of used heating gas from the annular chamber 84 and fresh air passes through the air conduit 80 to the second gas burner 76 as combustion air.

Moreover, a fuel gas conduit 106 to the gas burner 76 branches off from the return conduit 94 for the used heating gas of the second gas burner 76, through which fuel gas conduit this heating gas can be routed as fuel gas into the combustion chamber 76*a* of the gas burner 76. So that the heating gas of the second gas burner 76 can now flow uniformly around the drum wall 24 of the kiln drum 14, a helical conducting structure 108 is arranged in the annular chamber 84, so that the heating gas flows helically from the inlet connection 88 to the outlet connection 90 and around the kiln drum 14.

The heat input by the indirect heating device 72 into the drum chamber 22 is achieved on the one hand via the drum wall 24 and on the other hand also via the conveyor screw 54, which can take up the heat from the drum wall 24 and emit it to the material.

So that the kiln drum 14 withstands even abrasive materials, at least the drum wall 22 and/or the conveyor screw 54 of the kiln drum 14 are made of steel. In the operating concept explained here, the rotary kiln 12 can be formed as a solid steel welded construction.

As was explained at the beginning, the operating temperature in the kiln drum 14 in the rotary kiln 12 can be kept uniformly at a moderate temperature. Due to this, the volume flow of the flue gases produced remains relatively small, due to which their flow velocity is smaller also.

Material temperatures can be attained that lie only 100° C. below the maximum heating gas temperature. Due to the fact that a largely uniformly distributed temperature prevails in the drum chamber 22, the material moves across a large conveying section at the temperature at which the material is to leave the kiln drum 14.

The temperature in the drum chamber 22, the conveying speed and the dwell time of the material in the drum chamber 22 linked to this as well as the oxygen excess can additionally be adapted simply to the material to be processed by coordinating the direct and indirect heating device 68 and 72 of the heating system 70 to one another.

It is to be understood that additional embodiments of the present invention described herein may be contemplated by one of ordinary skill in the art and that the scope of the present invention is not limited to the embodiments disclosed. While the specific embodiments of the present invention have been illustrated and described, numerous modifications come to mind without significantly departing from the spirit of the invention, and the scope of protection is only limited in scope by the scope of the accompanying claims.

The invention claimed is:

1. A method for thermal processing a material comprising the steps of:

providing a rotary kiln with a rotatable kiln drum having a drum wall which delimits a heatable drum chamber, through which the material is conveyed from a drum inlet to a drum outlet of the rotatable kiln drum, wherein the heatable drum chamber is heated directly by conducting a heating gas into the heatable drum chamber, the heating gas being heated by a first heating device; and the heatable drum chamber is heated indirectly by warming the drum wall at least in areas by conducting a heating medium around the heatable drum chamber, the heating medium being heated by a second heating device;

treating the heating gas which is conducted directly into the heatable drum after the heating gas exits the drum and providing at least a portion of treated heating gas to the first heating device to be used as combustion air by the direct heating device; and providing at least a portion of the heating medium to the second heating device to be used as combustion air by the second heating device after the heating medium has been conducted around the heatable drum chamber.

2. The method according to claim 1, wherein the heating gas is conducted into the heatable drum chamber at the drum inlet of the rotatable kiln drum.

3. The method according to claim 1, wherein the drum wall is warmed by conducting the heating medium onto the drum wall from outside the kiln drum.

4. The method according to claim 3, wherein the heating medium is conducted in one direction from the drum outlet to the drum inlet of the rotatable kiln drum along the outside of the drum wall.

5. The method according to claim 3, wherein the heating medium is conducted through an annular chamber surrounding the rotatable kiln drum.

6. The method according to claim 1, wherein the rotatable kiln drum has at least one of the drum wall and a conveying structure on the inner shell surface of the drum wall made of steel.

7. A system for the thermal processing of a material comprising:

a) a rotary kiln with a rotatable kiln drum having a drum wall which delimits a heatable drum chamber, through which material can be conveyed from a drum inlet to a drum outlet of the rotatable kiln drum;

b) a heating system, by means of which the heatable drum chamber can be heated, wherein c) the heating system comprises a first heating device, by means of which the heatable drum chamber can be heated directly, in that a heating gas can be generated and conducted into the heatable drum chamber;

d) the heating system comprises a second heating device, by means of which the heatable drum chamber can be heated indirectly, in that the drum wall can be warmed at least in areas by a heating medium generated by the second heating device and conducted around the heatable drum chamber;

further wherein e) the heating gas conducted into the heatable drum chamber is conducted to a treatment device through a first conduit after exiting the drum chamber in order for the heating gas to be treated, and f) at least a portion of treated heating gas is conducted back to the first heating device through a distribution unit and second conduit, the at least a portion of treated heating gas conducted back to the first heating device being used to generate the heating gas, and g) at least a portion of the heating medium is conducted back to the second heating device through at least one heating medium return conduit after being conducted around the heatable drum chamber for use as a combustion gas by the second heating device.

8. The system according to claim 7, wherein the first heating device comprises a burner unit, which is arranged at the drum inlet of the rotatable kiln drum, so that heating gas is conducted into the heatable drum chamber there.

9. The system according to claim 7, wherein the second heating device comprises a burner unit, by which the heating medium can be generated, and at least one conduit through which the heating medium can be conducted onto the drum wall from outside the kiln drum.

10. The system according to claim 9, wherein the second heating device comprises a flow path, through which the heating medium can be conducted along the outside of the drum wall in the direction from the drum outlet to the drum inlet of the rotatable kiln drum.

11. The system according to claim 9, wherein the second heating device comprises a cladding tube with an inlet connection for the heating medium and an outlet connection for the heating medium, which tube is arranged coaxially to the rotatable kiln drum in such a way that an annular chamber surrounding the rotatable kiln drum is formed, through which the heating medium of the indirect heating device can be conducted.

12. The system according to claim 11, further comprising a helical conducting structure arranged in the annular chamber, so that the heating medium flows helically from the inlet connection to the outlet connection and around the rotatable kiln drum.

13. The system according to claim 7, wherein at least one of the drum wall and a conveying structure on the inner shell surface of the drum wall are made of steel.

14. The system according to claim 7 further comprising at least one fan, the at least one fan providing fresh air to the distribution unit through a third conduit for mixing with the at least a portion of treated heating gas before the at least a portion of treated heating gas is conducted to the first heating device.

15. The system of claim 14 wherein a second portion treated heating gas is expelled from the system by the distribution unit using a fourth conduit.

16. A system for the thermal processing of a material comprising:

a) a rotary kiln with a rotatable kiln drum having a drum wall which delimits a heatable drum chamber, through which material can be conveyed from a drum inlet to a drum outlet of the rotatable kiln drum;

b) a heating system, by means of which the heatable drum chamber can be heated, the heating system comprising ba) a first heating device for generating and conducting a direct heating gas into the heatable drum chamber;

bb) a second heating device for generating and conducting a heating medium about an outside portion of the drum wall;

c) a direct heating gas return system, wherein used direct heating gas exiting the the heatable drum chamber is conducted to a treatment device through a first conduit in order for the used direct heating gas to be treated, and at least a portion of treated direct heating gas is conducted back to the first heating device through a distribution unit and second conduit so that at least a portion of treated heating gas can be used to generate further direct heating gas, and d) a heating medium return system, wherein used heating medium is conducted back to the second heating device through at least one heating medium return conduit after being conducted around the outside portion of the drum wall for use as a combustion gas by the second heating device.

* * * * *